US006386350B1

(12) United States Patent
Sato

(10) Patent No.: US 6,386,350 B1
(45) Date of Patent: May 14, 2002

(54) CLUTCH MECHANISM OF OUTBOARD ENGINE

(75) Inventor: Takuya Sato, Shizuoka-Ken (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 09/606,273

(22) Filed: Jun. 29, 2000

(30) Foreign Application Priority Data

Sep. 30, 1999 (JP) ..... 11-280753

(51) Int. Cl.[7] ..... B63H 23/08

(52) U.S. Cl. ..... 192/51; 74/378; 74/470; 192/109 A; 440/75; 440/86; 464/160

(58) Field of Search ..... 192/48–91, 21, 192/51, 109 A, 93 R, 89.29; 440/75, 86; 464/62, 74, 82, 160; 74/108, 378, 470, 543, 545, 548

(56) References Cited

U.S. PATENT DOCUMENTS 1,572,519 A * 2/1926 Davis ..... 74/492
3,919,964 A * 11/1975 Hagen ..... 440/75
4,323,356 A * 4/1982 Stephenson ..... 440/86
4,579,204 A * 4/1986 Iio ..... 192/21
4,747,796 A * 5/1988 Iwai et al. ..... 464/160 X
4,924,724 A * 5/1990 Yoshimura ..... 440/75 X
5,006,084 A * 4/1991 Handa ..... 440/75
5,059,144 A * 10/1991 Onoue ..... 440/75
5,173,716 A * 12/1992 Tetsuka ..... 464/160 X
5,445,546 A * 8/1995 Nakamura ..... 440/75

FOREIGN PATENT DOCUMENTS

JP 11-129988 A * 5/1999
JP 11230331 8/1999
JP 10299502 11/1999

* cited by examiner

*Primary Examiner*—Rodney H. Bonck
(74) *Attorney, Agent, or Firm*—Morrison Law Firm

(57) ABSTRACT

A clutch mechanism of an outboard engine provides improved feel of shifting operation while allowing a detent mechanism and a stopper to fully perform their functions. The clutch mechanism has a shift cam which is remotely operable through a clutch rod and a shift rod, so as to switch the direction of rotation of a propeller shaft within a gear case. The clutch mechanism has an assist device acting between the clutch rod and the shift rod. The assist device has a rotary drive member connected to the clutch rod, a rotary driven member connected to the shift rod and driven by the drive member, and an elastic member disposed to act between the drive member and the driven member.

7 Claims, 6 Drawing Sheets

CLUTCH MECHANISM OF OUTBOARD ENGINE

BACKGROUND OF THE INVENTION

1. Field of the Invention

The present invention relates to a clutch mechanism of an outboard engine.

2. Description of the Related Art

In general, an outboard engine has a clutch mechanism which is remotely-operable to change over the direction of rotation of a propeller shaft between "forward" and "reverse" passing through a "neutral" state. To enable such a change-over of direction of rotation, the propeller shaft has a push rod incorporated therein. The push rod is moved back and forth to bring a clutch dog into and out of engagement with the propeller shaft. This arrangement is generally known as "shift-in and shift-out" structure. A shift cam is typically used as means for effecting the back-and-forth movement of the push rod.

The shift cam has a cam profile which is defined by three curved recesses that are smoothly connected one to another. These three recesses have different depths corresponding to three shift positions, i.e., the "forward", "reverse" and "neutral" states, of the clutch mechanism. The above-mentioned push rod is normally spring-biased towards the cam, so as to rest in one of the three recesses, thus selecting one of the three shift positions.

There are two types of the shift cam: a vertically-movable shift cam which moves up and down to bring different recesses into engagement with the push rod; and a rotational shift cam which rotates within a horizontal plane. The rotational shift cam imparts to the operator a better feel of manipulation and is used mainly for large-sized outboard engines.

The shift cam is associated with a suitable means which retains the shift cam in the neutral position. For instance, a linearly-movable shift cam may have a detent mechanism with a rigid ball spring-biased into a dent formed in the back side, i.e., the side opposite to the recesses, of the shift cam.

Thus, the detent mechanism can easily be located in the vicinity of the shift cam, when the cam is of the linearly movable type. With the rotational shift cam, however, it is not easy to find a space in the close proximity of the shift cam for accommodating the detent mechanism. The detent mechanism therefore has to be disposed at a location spaced away from the shift cam, e.g., on a portion of a clutch rod.

The rotational shift cam has a stopper for preventing the cam from rotating beyond limit rotational positions. As in the case of the detent mechanism, the stopper cannot be disposed in the vicinity of the shift cam. The stopper is therefore arranged at a position remote from the shift cam, e.g., on a portion of the clutch rod.

During shifting from the forward position to the neutral position and from the neutral position to the reverse position, and vice versa, the end of the push rod engaging the shift cam has to slide along a peak or a crest between the two recesses of the cam profile, thus encountering a significant resistance or load, which impairs the feel of the shifting operation.

Locating the detent mechanism at a position remote from the shift cam allows the detent mechanism to act on the shift cam only indirectly. This leads to problems such as a time lag until the detent force is actually exerted on the shift cam. In addition, there is a risk that the clutch mechanism may be erroneously brought back into the shift-in condition even when the detent mechanism is operative.

It is also to be noted that assembly or setup of the clutch mechanism cannot be performed unless the shift cam is fixed exactly in the neutral position by the detent function. Fixing of the shift cam exactly at the neutral position is also essential for enabling confirmation of the shift-in and shift-out positions after the setup.

Likewise, locating the stopper at a place remote from the shift cam may lead to troubles such as unintentional continuation of the shift-in state despite safe functioning of the stopper.

SUMMARY OF THE INVENTION

In view of the foregoing, it is an object of the present invention to provide a clutch mechanism which is used in an outboard engine and which ensures full functioning of a detent mechanism and a stopper, while offering improved feel of the shifting operation.

To this end, according to the present invention, there is provided a clutch mechanism of an outboard engine, comprising: a remotely-operable shift cam for switching the direction of rotation of a propeller shaft in a gear case of the outboard engine; a clutch rod and a shift rod through which the shift cam is remotely operated; and an assist device provided to act between the clutch rod and the shift rod, the assist device including a drive member connected to the clutch rod, a driven member connected to the shift rod and driven by the drive member, and a resilient member disposed to act between the drive member and the driven member.

The drive member and the driven member may be rotary members, and the assist device may have a shift housing which rotatably supports and receives the rotary drive member and the rotary driven member. With this arrangement, the clutch mechanism may have a detent mechanism on the shift housing and which includes a rigid ball, a spring for urging the rigid ball against the outer peripheral surface of the rotary driven member, and a plurality of recesses formed in the outer peripheral surface of the rotary driven member, the spring urging and pressing the rigid ball into engagement with one of the recesses.

Preferably, the driven member is provided with a stopper projecting from the outer peripheral surface thereof, while the shift housing has a cylindrical hub surrounding and supporting the driven member, the cylindrical hub having a cutout portion which receives the stopper such that the range of rotational movement of the stopper is limited by both ends of the cutout portion, whereby the range of rotation of the driven member is limited.

Preferably, a projection for retaining the elastic member is provided on the drive member.

Preferably, the projection has an arcuate form concentric with the drive member.

The arrangement may be such that the end of the projection makes surface contact with a portion of the driven member.

Preferably, the spring which urges the rigid ball against the outer peripheral surface of the driven member is arranged to extend obliquely downward within the shift housing when viewed in side elevation.

The above and other objects, features and advantages of the present invention will become clear from the following description of a preferred embodiment with reference to the accompanying drawings.

DESCRIPTION OF THE PREFERRED EMBODIMENT

Figure 1:
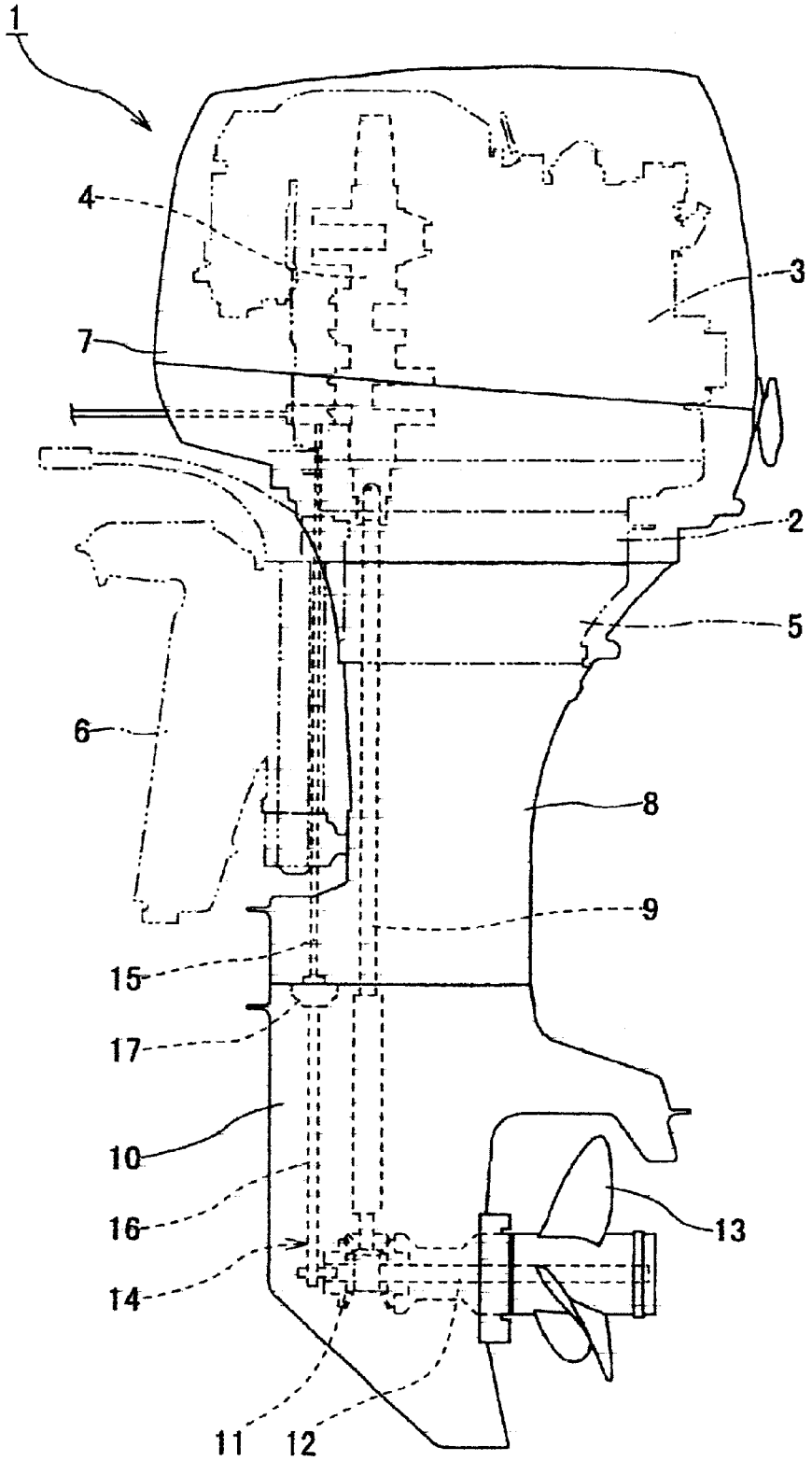
FIG. 1 is an elevational view of an outboard engine incorporating an embodiment of the clutch mechanism of the present invention, as viewed from the port side.

Referring first to FIG. 1, an outboard engine 1 has an engine holder 2 on which is mounted an engine unit 3. The engine unit 3 is a so-called vertical engine with a crankshaft 4 extending substantially vertically.

An oil pan 5 is disposed beneath the engine holder 2. A clamp bracket 6, attached to the engine holder 2 for example, clamps a transom of the boat's hull (not shown), whereby the outboard engine 1 is secured to the hull. The engine unit 3 and the engine holder 2 are covered by an engine cover 7.

A drive shaft housing 8 is provided under the oil pan 5. A drive shaft 9 extends substantially vertically through the engine holder 2, oil pan 5 and the drive shaft housing 8. The drive shaft 9 is connected at its upper end to the lower end of the crankshaft 4. The drive shaft 9 extends downward through the drive shaft housing 8. Drive shaft 9 drives, through bevel gears 11 disposed in a gear case 10 provided under the drive shaft housing 8 and through a propeller shaft 12, a propeller 13 which propels a boat or the like.

The outboard engine 1 is provided with a remote-controlled clutch mechanism 14 which changes the direction of rotation of the propeller shaft 12 from "forward" to "reverse" via a "neutral" state, and vice versa.

Figure 2:
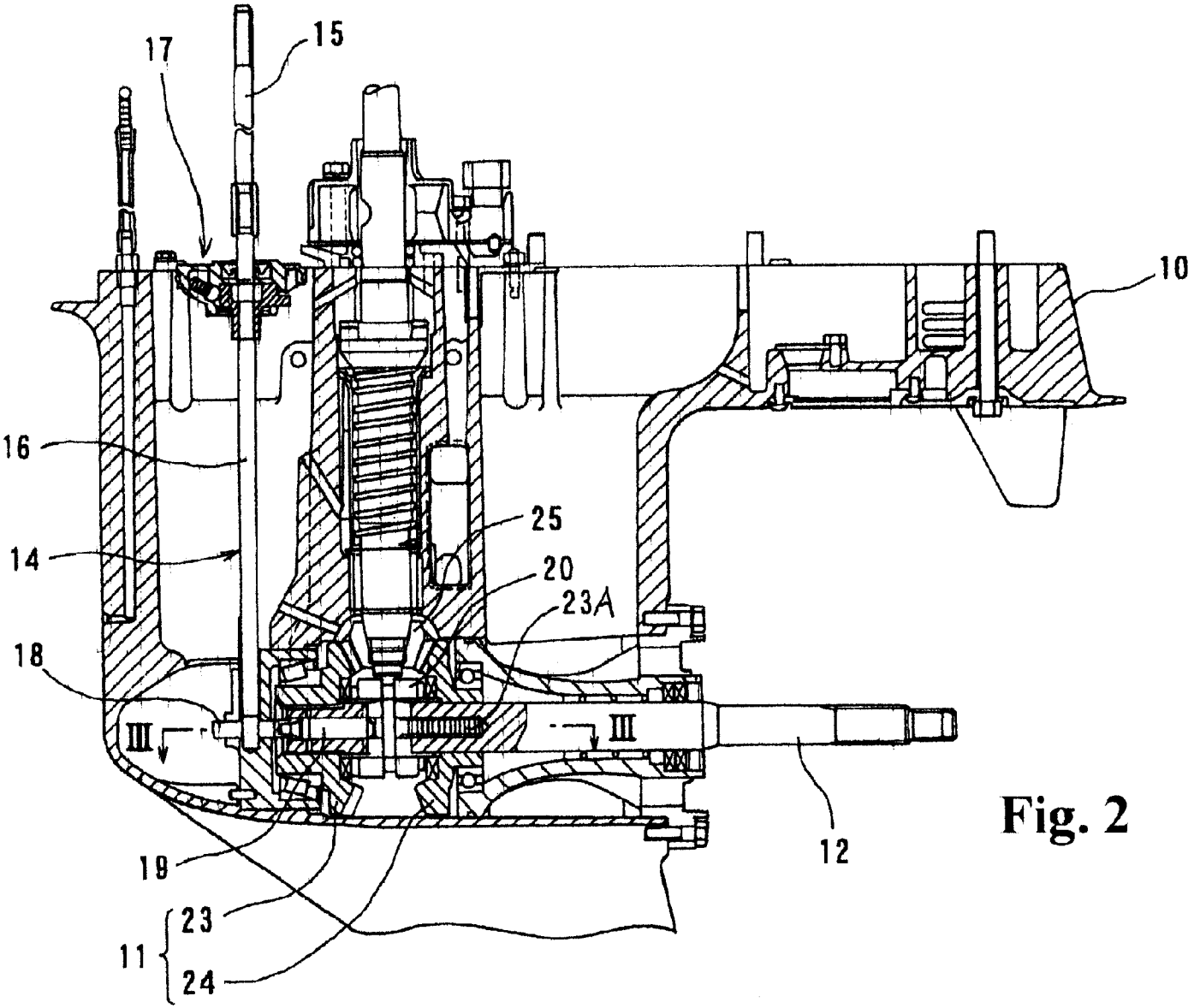
FIG. 2 is an enlarged sectional view of the gear case of FIG. 1.
Figure 3:
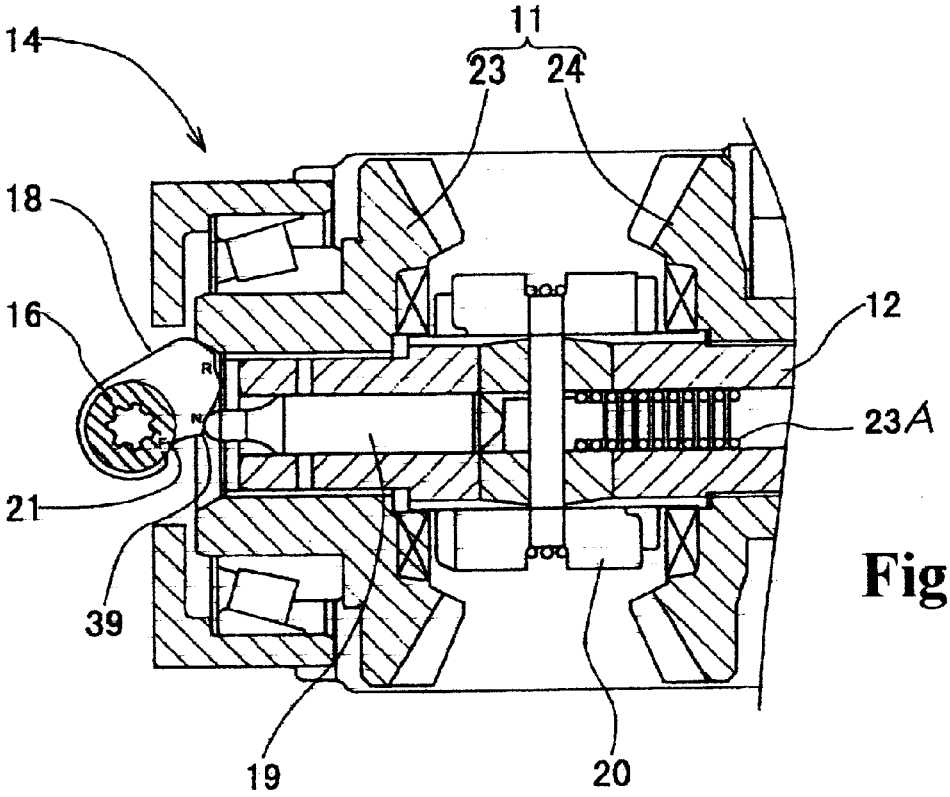
FIG. 3 is a sectional view taken along the line III—III of FIG. 2.

Referring to FIGS. 2 and 3, the clutch mechanism 14 has major parts including a clutch rod 15, a shift rod 16, an assist device 17, a shift cam 18, a push rod 19 and a clutch dog 20. The clutch rod 15 extends towards the gear case 10 from, for example, a position in the engine cover 7 near the engine unit 3, and is connected to the shift rod 16 via the assist device 17 which is disposed in the portion of the gear case 10 adjoining the drive shaft housing 8. The arrangement is such that, when an operator on board manipulates a shift lever (not shown) or the like, the motion of the shift lever is converted into a rotational motion of the clutch rod 15 which is then transmitted to the shift rod 16.

The shift cam 18 is fixed to the lower end of the shift rod 16 so as to rotate together with the shift rod 16. As will be seen from FIG. 3, the shift cam 18 has a cam profile composed of three consecutive curved recesses 21 which respectively correspond to the "forward" (F), "neutral" (N) and the "reverse" (R) shift positions. These recesses have bottoms that are at different radial directions from the axis of rotation of the shift cam 18. The push rod 19 is received in a bore formed in the propeller shaft 12, so as to be movable in the direction of the axis of the propeller shaft 12. The push rod 19 is always biased by a spring 23A against the shift cam 18, so that the end of the push rod 19 rests in one of the recesses 21 of the shift cam 18, whereby the clutch mechanism 14 is set to one of the three shift positions.

The aforementioned bevel gears 11 include a forward driven gear 23 and a reverse driven gear 24 which are rotatably carried by the propeller shaft 12. These driven gears 23 and 24 are always held in driving engagement with a drive gear 25 fixed to the lower end of the drive shaft 9. The clutch dog 20 serves to drivingly connect either one of the forward driven gear 23 and the reverse driven gear 24 to the propeller shaft 12, while disconnecting the other from the same, in accordance with the axial position of the push rod 19. The clutch dog 20 also holds the clutch mechanism 14 in the neutral state in which both the forward and reverse driven gears 23 and 24 are freed from the propeller shaft 12.

Figure 4:
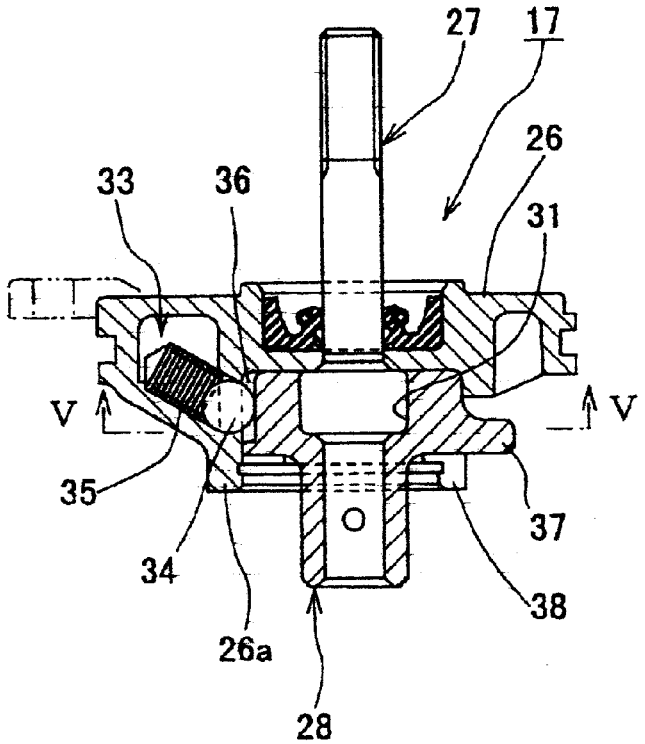
FIG. 4 is a longitudinal sectional view of an assist device which interconnects a clutch rod and a shift rod.
Figure 5:
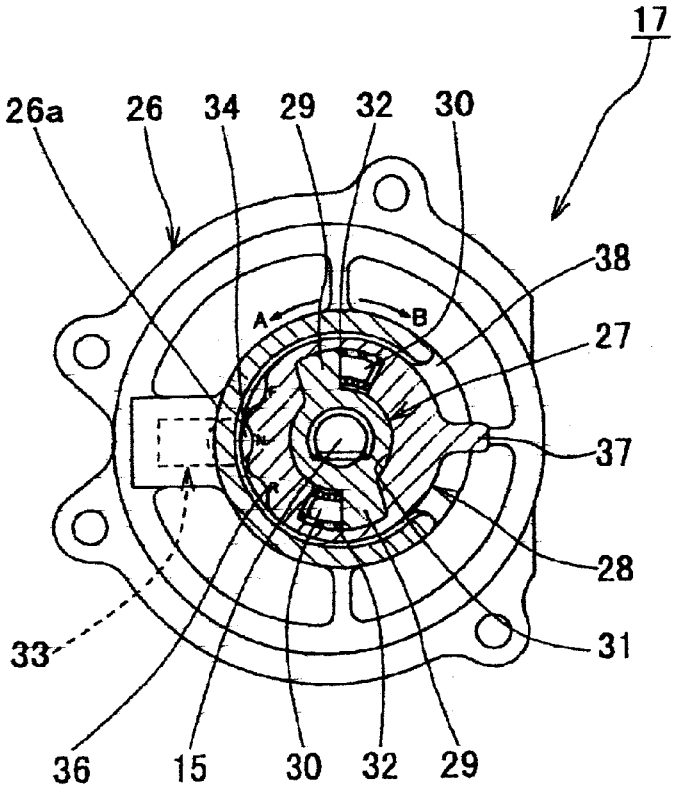
FIG. 5 is a sectional view taken along the line V—V of FIG. 4.

Referring now to FIGS. 4 and 5 the assist device 17 has a shift housing 26 which rotatably houses and supports a rotary drive member 27 and a rotary driven member 28. The rotary drive member 27 is connected at its upper end to the clutch rod 15, while the rotary driven member 28 is connected at its lower end to the shift rod 16. The upper end of the rotary driven member 28 fits in the lower end of the driven member 27.

Referring specifically to FIG. 5, the rotary drive member 27 is provided with a pair of radial wings 29. Arcuate projections 30 concentric with the rotary drive member 27 project from side faces of the wings 29. The rotary driven member 28 has a central bore configured to receive the main part of the rotary drive member 27 together with the wings 29 and the projections 30. More specifically, in the illustrated embodiment, the central bore 31 has radially expanded portions which receive the wings 29 and the projections 30. In each of such radial expanded portions, each projection circumferentially opposes one end wall of the radial expansion of the central bore 31, leaving a slight circumferential gap therebetween. Elastic members such as coiled springs 32 are loaded in these circumferential gaps, so as to urge the wings 29 in the direction opposite to the projections 30, i.e., in the direction indicated by "A" in FIG. 5.

The shift housing 26 has a detent mechanism 33 which includes a rigid ball 34, a spring 35 which urges the rigid ball 34 against the peripheral surface of the rotary driven member 28, and three consecutive curved recesses 36 formed in the peripheral surface of the rotary driven member 28. This arrangement provides a kind of clicking mechanism in which the rigid ball 34 is received in one of the recesses 36 so as to keep the rotary driven member 28 at one of the three shift positions. Thus, the three recesses 36 respectively correspond to the "forward" (F), "neutral" (N) and the "reverse" (R) positions. As will be seen from FIG. 4, the spring 35 which presses the rigid ball 34 against the outer peripheral surface of the rotary driven member 28 urges the rigid ball 34 obliquely downward (as viewed in side elevation) into one of the recesses 36.

A stopper 37 is formed on the outer peripheral surface of the rotary driven member 28 so as to project radially outward therefrom. The stopper 37 prevents the driven member from rotating beyond each limit position where the push rod engages with one of two outer recesses 36. The stopper 37 is positioned within a cutout portion 38 of a cylindrical hub 26*a* of the shift housing 26. The cylindrical hub 26*a* surrounds and holds the outer peripheral surface of the rotary driven member 28.

The operation of this embodiment is as follows.

An operator of a boat manipulates a shift lever (not shown) so that the clutch rod 15 and, hence, the shift rod 16 are rotated, thereby rotating the shift cam 18 fixed to the lower end of the shift rod 16. As a result of the rotation of the shift cam 18, the end of the push rod 19 that has been held in engagement with one of the recesses 21 is moved to engage a recess 21 which is adjacent to the first-mentioned recess 21. Since the radial distances of the bottoms of these recesses from the axis of rotation of the shift cam 18 are different, the push rod 19 is moved within the propeller shaft 12 along the axis of the propeller shaft, thereby selectively connecting one of the bevel gears 11 with the propeller shaft or disconnecting these bevels gears 11 from the propeller shaft.

During shifting from the "forward" position to the "neutral" position or from the "neutral" position to the "reverse" position, the end of the push rod 19 slides along the lobe or crest of the cam profile between two recesses 21. This produces a certain level of resistance or load, thus imparting to the operator a "heavy" or unpleasant feel of operation.

In accordance with the present invention, the load encountered during the shifting is lessened by the assist device 17 which acts between the clutch rod 15 and the shift rod 16.

More specifically, when the clutch rod 15 is rotated from the neutral position to cause the rotary drive member 27 to move in the direction of the arrow B for example, the rotary driven member 28 is also rotated in the same direction B accompanying the rotary drive member 27.

Figure 6:
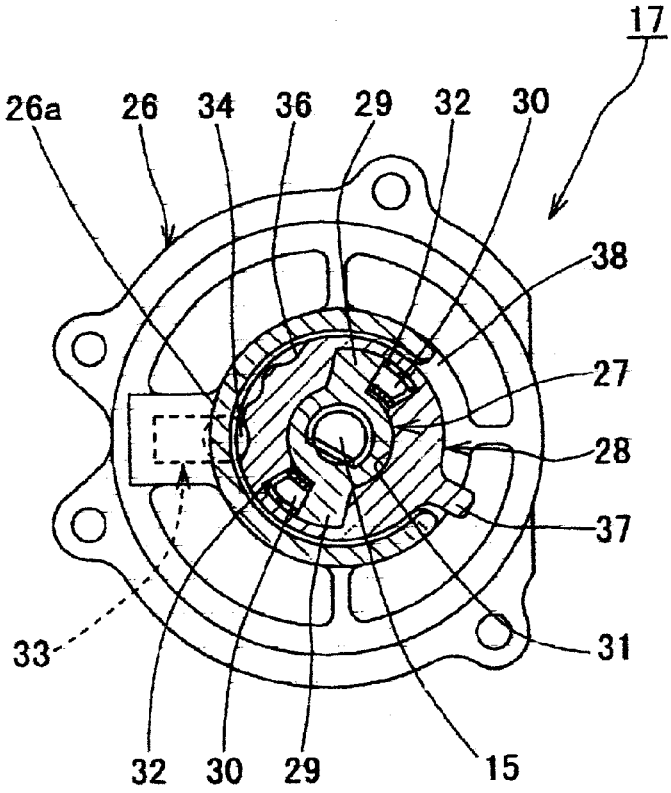
FIG. 6 is a bottom plan view of the assist device in a "shift-in" condition.

As stated before, coiled springs 32 are loaded between the ends of the projections 30 of the rotary drive member 27 and the portions of the rotary driven member 28 opposing these ends of the projections 30. Thus, the coiled springs 32 are compressed at the beginning of the rotation of the rotary drive member 27 and, thereafter, produce rebounding forces that act to rotationally drive the rotary driven member 28. Further rotation of the rotary drive member 27 brings the ends of the projections 30 of the rotary drive member 27 into engagement with opposing wall portions of the rotary driven member 28, whereby the rotary driven member 28 is further rotated to effect the shifting without fail, as will be seen from FIG. 6.

In the above-described shifting operation, the rebounding forces produced by the springs 32 serve to reduce the initial load, thus imparting better feel of shifting operation.

It is also to be appreciated that the projections 30 provided on the wings 29 of the rotary drive member 27 serve to retain the springs 32 thereby effectively preventing the springs 32 from coming off or from being displaced.

Further, the projections 30 are formed in arcuate form concentric with the rotary drive member 27 such that their ends make surface contact with the close to the shift cam 18.

Further, the assembly of the clutch mechanism 14 is facilitated because the shift cam 18 can be stably fixed in the neutral position by the effect of the detent mechanism 33. For the same reason, the work for confirming the shift-in and shift-out positions after the assembly of the clutch mechanism 14 is also facilitated.

The rigid ball 34 of the detent mechanism is pressed against the outer peripheral surface of the rotary driven member 28 by the spring 35 which is arranged to extend obliquely downward towards the recess 36 when viewed in side elevation. This effectively serves to reduce the diameter of the shift housing 26, contributing to reduction in the size and weight of the assist device 17.

The stopper 37 provided on the outer peripheral surface of the rotary driven member 28 is movable only within the cutout portion 38 of the cylindrical hub 26*a* of the shift housing 26 which surrounds and holds the rotary driven member 28, thus limiting the range of rotation of the rotary driven member 28. This effectively prevents the rotary driven member 28 from being rotated beyond the positions where the push rod 19 engages the two outer recesses 36, as will be seen from FIG. 6. Further, since the stopper 37 is disposed within the gear case 10 at a position close to the shift cam 18, inspection or test after the assembly of the clutch mechanism can be conducted without risk of the push rod 19 moving from a shift position, even if an excessive shifting operation is performed during the test.

In the embodiment described heretofore, the assist device 17 which is one of the critical features of the invention is combined with the clutch mechanism 14 of the type which employs a rotary cam 18 that rotates within a horizontal plane. This, however, is not exclusive and the assist device 17 may be combined with a clutch mechanism of the type which employs a vertically movable shift cam, as will be understood from the following description of a second embodiment of the present invention.

Figure 7:
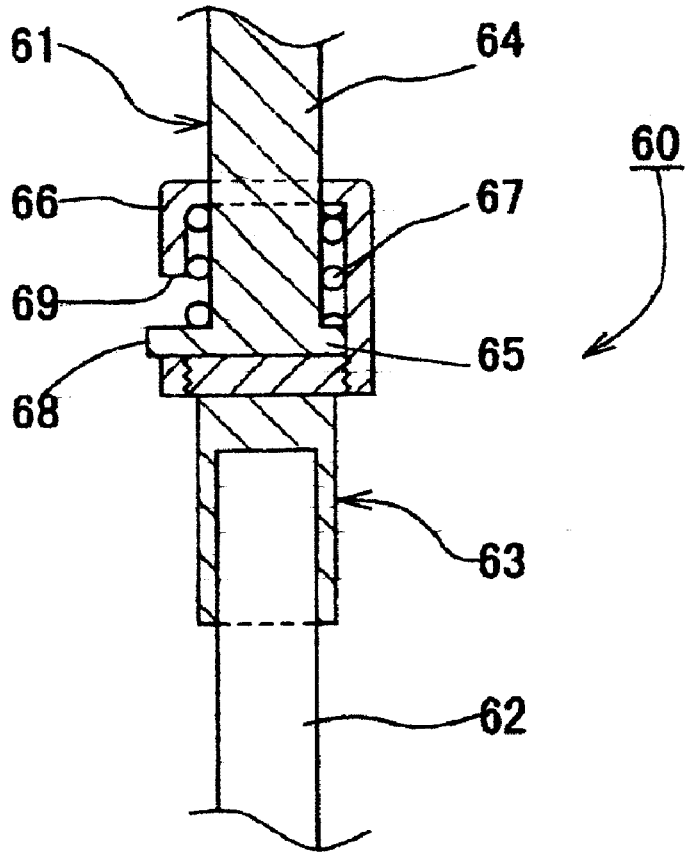
FIG. 7 is a longitudinal view of a structure of the assist device used in a second embodiment of the present invention.

Referring to FIG. 7, the second embodiment incorporates an assist device 60 which has a slidable drive member 61 connected to the lower end of a clutch rod (not shown) and a slidable driven member 63 connected to the upper end of a shift rod 62.

For instance, the slidable drive member 61 has a columnar rod portion 64 and a flange portion 65 provided on the lower end of the rod portion 64. On the other hand, the slidable driven member 63 is provided at its upper end with a cap member 66 attached thereto. The cap member 66 has an internal bore of a diameter greater than that of the rod portion 64 of the slidable drive member 61. The rod portion 64 extends downward through an opening formed in the top end of the cap member 66, so that the above-mentioned flange portion 65 is disposed within the cap member 66. A spring 67 is loaded between the flange 65 and the top wall of the cap member 66. The spring 67 urges the flange portion 65 so as to keep the flange 65 in contact with the upper end of the slidable driven member 63. The flange portion 65 of the slidable drive member 61 has a radially projecting claw 68 which engages a cutout portion 69 formed in the cap member 66.

In operation, when the operator operates a shift lever (not shown) so as to push the clutch rod downward, the flange portion 65 of the slide member 61 is pressed against the slidable driven member 63 so as to press the shift rod 62 downward.

Conversely, when the operator operates the shift lever so as to pull the clutch rod upward, the flange portion 65 of the slidable drive member 61 acts the compress the spring 67 upward. Therefore, in the beginning period of this operation, the spring 67 is compresses and charged to produce a rebounding force which tends to pull the slidable driven member 63 upward together with the cap member 66. Further upward pulling of the slidable drive member 61 brings the claw 68 of the flange portion 65 into contact with an end of the cutout portion 69, whereby the slidable driven member 63 is further pulled upward to effect the shifting without fail.

It will be seen that, during the shifting operation as described above, the rebounding force produced by the spring 67 serves to reduce the initial load, thus imparting better feel of the shifting operation.

In the first and- second embodiments described heretofore, the assist device is combined with clutch mechanisms of the type in which the clutch rod and the shift rod are arranged on a common axis. Obviously, however, the assist device can be used for a clutch mechanism of the type in which the clutch rod and the shift rod are arranged at an offset from each other, as will be understood from the following description of the third embodiment taken in conjunction with FIGS. 8 and 9.

Figure 8:
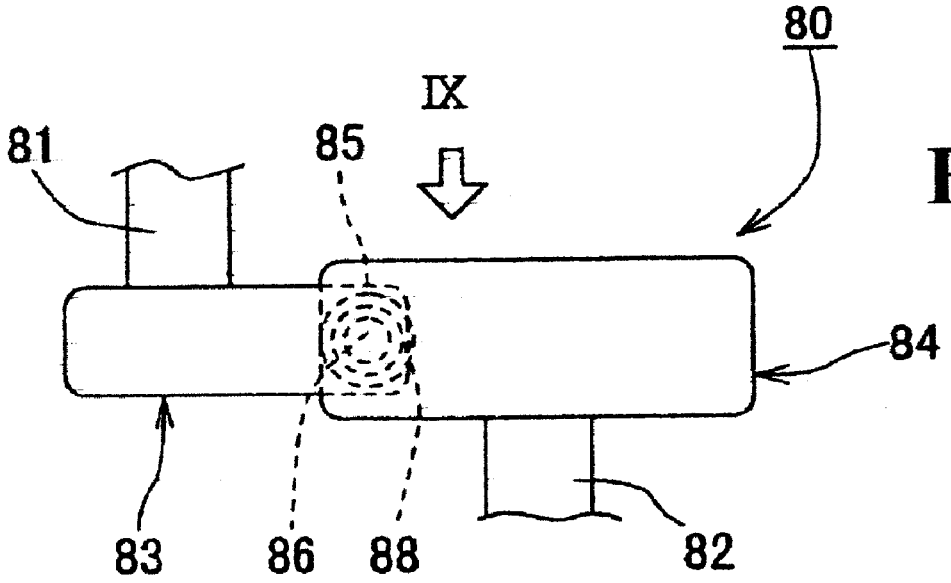
FIG. 8 is a longitudinal view of a structure of the assist device used in a third embodiment of the present invention.
Figure 9:
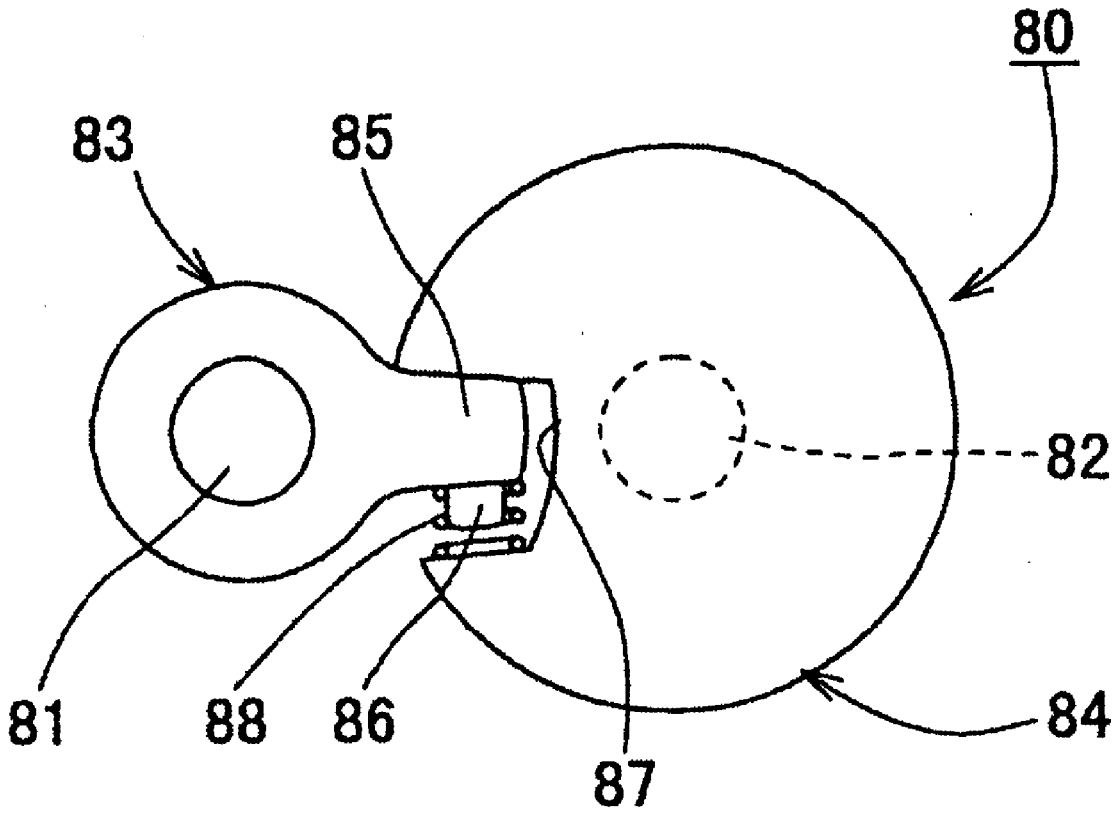
FIG. 9 is an illustration of the assist device as viewed in the direction of the arrow IX of FIG. 8.

Referring to FIGS. 8 and 9, a clutch mechanism in accordance with the third embodiment has an assist device 80, and a clutch rod 81 and shift rod 82 that are offset from each other in the breadthwise (or longitudinal) direction of a boat or the like. A rotary drive member 83 is provided on the lower end of the clutch rod 81, while a rotary driven member 84 is provided on the upper end of the shift rod 82.

The rotary drive member 83 has a radial arm 85. A projection 86 having an arcuate form concentric with the rotary drive member 83 projects from one side of the arm 85. Meanwhile, the rotary driven member 84 is provided at its peripheral portion with a recess 87 capable of receiving and engaging with the arm 85 and the projection 86 of the rotary member 83. A slight gap is formed between the end of the projection 86 of the rotary member 83 and an opposing all portion of the recess 87 of the rotary driven member 84. A spring 88 fitting around the projection 86 of the rotary drive member 83 urges the arm 85 in the direction opposite to the projection 86.

In operation, when the operator operates the shift lever (not shown) so as to rotate the clutch rod 81, the rotary drive member 83 is rotated in the same direction as the clutch rod 81, which in turn causes the rotary driven member 84 to rotate in the direction counter to the direction of rotation of the rotary drive member 83.

As stated before, a slight gap is left between the end of the projection 86 on the rotary drive member 83 and the opposing wall of the recess 87 in the rotary driven member 84, with the spring 88 fitting around the projection 83. Therefore, the spring 88 is contracted and charged in the beginning period of the rotation of the rotary drive member 83 so as to produce a rebounding force which acts to rotate the rotary driven member 84. A further rotation of the rotary drive member 83 brings the end of the projection 86 of the rotary drive member 83 into surface contact with the opposing wall of the recess 87 in the rotary driven member 84, thereby causing further rotation of the rotary driven member 84 so as to effect the shifting without fail.

It will be seen that in the above-described shifting operation that the rebounding force produced by the spring 88 serves to reduce the initial load, thus imparting improved feel of the shifting operation.

As will be understood from the foregoing description, the present invention provides a clutch mechanism of an outboard engine, comprising: a remotely-operable shift cam for switching the direction of rotation of a propeller shaft in a gear case of the outboard engine; a clutch rod and a shift rod through which the shift cam is remotely operated; and an assist device provided to act between the clutch rod and the shift rod, the assist device including a drive member connected to the clutch rod, a driven member connected to the shift rod and driven by the drive member, and an elastic member disposed to act between the drive member and the driven member.

This arrangement reduces the load encountered at the beginning of the shifting operation, thus offering a better feel of the shifting operation.

In a preferred from of the invention, the drive member and the driven member are rotary members, and the assist device has a shift housing which rotatably supports and receives the rotary drive member and the rotary driven member. With this arrangement, the clutch device further comprises a detent mechanism provided on the shift housing, the detent mechanism including a rigid ball 34, a spring 35 for urging the rigid ball against the outer peripheral surface of the rotary driven member, and a plurality of recesses formed in the outer peripheral surface of the rotary driven member, the spring urging and pressing the rigid ball into engagement with one of the recesses. This arrangement ensures that each shift position be definitely determined with good feel of clicking, thus offering a better feel of shifting operation, while reducing any time lag in the shifting operation and facilitating the assembly of the clutch mechanism.

The driven member may be provided with a stopper projecting from the outer peripheral surface thereof, while the shift housing has a cylindrical hub surrounding and supporting the driven member, the cylindrical hub having a cutout portion which receives the stopper such that the range of rotational movement of the stopper is limited by both ends of the cutout portion, whereby the range of rotation of the driven member is limited. This arrangement effectively prevents the driven member from rotating beyond limit positions.

The drive member may have a projection for retaining the elastic member. This ensures that the elastic member is always held in the correct position, without being displaced or coming off.

The projection preferably has an arcuate form concentric with the drive member. This ensures that the torque of the drive member is efficiently transmitted to the driven member.

Preferably, the arrangement may be such that the end of the projection makes surface contact with a portion of the driven member. This also offers high efficiency of transmission of the torque from the drive member to the driven member.

The spring which urges the rigid ball against the outer peripheral surface of the driven member may arranged to extend obliquely downward within the shift housing when viewed in side elevation. This serves to reduce the diameter of the shift housing.

Although the invention has been described through its preferred forms, it is to be understood that the described embodiments are only illustrative and various changes and modifications may be imparted thereto without departing from the scope of the present invention which is limited solely by the appended claims.

What is claimed is:

1. A clutch mechanism of an outboard engine comprising:

a remotely-operable shift cam for switching the direction of rotation of a propeller shaft in a gear case of the outboard engine;

a clutch rod and a shift rod cooperatively operable to remotely operate said shift cam;

an assist device between said clutch rod and said shift rod;

said assist device including a drive member connected to said clutch rod and a driven member connected to said shift rod;

said drive member being operable to drive said driven member;

an elastic member between said drive member and said driven member;

said elastic member being compressible during an initial portion of shifting, whereby improved feel is attained during shifting;

said driven member includes a stopper projecting from the outer peripheral surface thereof;

a cylindrical hub in said shift housing surrounding and supporting said driven member;

a cutout portion in said cylindrical hub; and said cutout portion receives said stopper whereby a range of rotational movement of said stopper is limited by ends of said cutout portion, and thereby a range of rotation of said driven member is limited.

2. A clutch mechanism according to claim 1, further comprising a projection on said drive member for retaining said elastic member.

3. A clutch mechanism according to claim 2, wherein an end of said projection makes surface contact with a portion of said driven member.

4. A clutch mechanism according to claim 2, wherein said projection has an arcuate form concentric with said drive member.

5. A clutch mechanism according to claim 4, wherein an end of said projection makes surface contact with a portion of said driven member.

6. A clutch mechanism of an outboard engine comprising:

a remotely-operable shift cam for switching the direction of rotation of a propeller shaft in a gear case of the outboard engine;

a clutch rod and a shift rod cooperatively operable to remotely operate said shift cam;

an assist device between said clutch rod and said shift rod;

said assist device including a drive member connected to said clutch rod and a driven member connected to said shift rod;

said drive member being operable to drive said driven member;

an elastic member between said drive member and said driven member;

said elastic member being compressible during an initial portion of shifting, whereby improved feel is attained during shifting said drive member and said driven member are rotary members;

said assist device has a shift housing rotatably supporting and receiving the rotary drive member and the rotary driven member;

a detent mechanism on said shift housing;

said detent mechanism including a rigid ball;

a spring positioned to urge said rigid ball against an outer peripheral surface of said rotary driven member;

a plurality of recesses in the outer peripheral surface of said rotary driven member;

said spring urging and pressing said rigid ball into engagement with a selectable one of said recesses said driven member includes a stopper projecting from the outer peripheral surface thereof;

a cylindrical hub in said shift housing surrounding and supporting said driven member;

a cutout portion in said cylindrical hub; and said cutout portion receives said stopper whereby a range of rotational movement of said stopper is limited by ends of said cutout portion, and thereby a range of rotation of said driven member is limited.

7. A clutch mechanism according to claim 6, wherein:

said spring extends obliquely downward within said shift housing when viewed in side elevation, whereby a transverse dimension of said shift housing is reduced.

* * * * *